US009298139B2

(12) United States Patent
Suzuki et al.

(10) Patent No.: US 9,298,139 B2
(45) Date of Patent: Mar. 29, 2016

(54) IMAGE FORMING APPARATUS FOR COLLECTING TONER FROM A ROTATABLE TRANSFER BELT THROUGH USE OF A MOVABLE BLADE

(71) Applicant: CANON KABUSHIKI KAISHA, Tokyo (JP)

(72) Inventors: Yoshimi Suzuki, Numazu (JP); Chikara Imaizumi, Numazu (JP); Kazushi Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/669,204

(22) Filed: Mar. 26, 2015

(65) Prior Publication Data

US 2015/0277298 A1 Oct. 1, 2015

(30) Foreign Application Priority Data

Mar. 28, 2014 (JP) ..... 2014-068263

(51) Int. Cl.
*G03G 15/16* (2006.01)

(52) U.S. Cl.
CPC ..... *G03G 15/168* (2013.01); *G03G 15/161* (2013.01); *G03G 2215/0132* (2013.01)

(58) Field of Classification Search
CPC ..... G03G 15/168
USPC ..... 399/101, 302, 308
See application file for complete search history.

(56) References Cited

U.S. PATENT DOCUMENTS 8,903,260 B2 * 12/2014 Woo ..... 399/101
2013/0094880 A1 * 4/2013 Suzuki et al. ..... 399/101

FOREIGN PATENT DOCUMENTS

JP 09-80999 A 3/1997
JP 2003-122228 A 4/2003
JP 2003177584 A * 6/2003
JP 2005-338732 A 12/2005
JP 2010117449 A * 5/2010

OTHER PUBLICATIONS

Kenji Suzuki, U.S. Appl. No. 14/580,726, filed Dec. 23, 2014.

* cited by examiner

*Primary Examiner* — Susan Lee
(74) *Attorney, Agent, or Firm* — Fitzpatrick, Cella, Harper & Scinto

(57) ABSTRACT

An image forming apparatus includes: a transfer unit including a stretching roller and a rotatable transfer belt stretched by the stretching roller; a cleaning unit, including a blade movable toward and away from the transfer belt, for collecting a toner removed from the transfer belt by the blade; a moving member for moving the blade between a contact position where the blade is contacted to the transfer belt and a retracted position where the blade is moved away from the transfer belt; and a drive transmission device for permitting transmission of a driving force between the stretching roller and the movable member. The drive transmission device has an idling region where the drive transmission device is rotatable by a predetermined amount without transmitting the driving force to the stretching roller when the driving force is transmitted from the moving member to the drive transmission device.

14 Claims, 8 Drawing Sheets

IMAGE FORMING APPARATUS FOR COLLECTING TONER FROM A ROTATABLE TRANSFER BELT THROUGH USE OF A MOVABLE BLADE

FIELD OF THE INVENTION AND RELATED ART

The present invention relates to an image forming apparatus including a toner collecting device for collecting a toner remaining on an image bearing member after a toner image is transferred onto a transfer(-receiving) material such as paper.

The image forming apparatus of an electrophotographic type includes a cleaning means for removing the toner remaining on a transfer belt by using a mechanical force or an electrostatic force. A belt cleaner as one of the cleaning means has a function of removing a residual toner remaining on the transfer belt.

For a member for removing the residual toner, a rubber blade or the like is used. This blade is pressed by a spring or the like and thus is contacted to a transfer belt surface, so that the toner on the transfer belt is scraped off and thus the residual toner on the transfer belt is removed.

The removed residual toner is collected in a cleaner container. The residual toner collected in the cleaner container is fed to a toner portion, for permitting discharge of the residual toner, by a toner feeding member provided in the cleaner container, and then is discharged into another toner feeding device or a toner collecting container through the toner portion.

Use of a helical member, such as a plastic screw or a metal coil spring, as the toner feeding member goes mainstream. In either case, the toner is fed by rotating the toner feeding member in a toner feeding path.

The blade always receives an urging force, by the spring or the like, toward a side where the blade is contacted to the transfer belt. For that reason, in the case where the blade is left standing for a long time when the blade is not used, the blade is plastically deformed in some cases by the influence of ambient temperature and humidity. In the case where the blade is plastically deformed, there was a liability that the residual toner cannot be sufficiently removed due to deviation of a contact position of the blade with the transfer belt from a proper position or a change in manner of flexure of the blade itself.

However, in recent years, the blade for removing the residual toner has a constitution in which the blade is moved away from the transfer belt when the blade is not used as disclosed in Japanese Laid-Open Patent Application JP-A Hei 09-80999 and JP-A 2005-338732. That is, the blade is moved, by a predetermined amount, toward a side away from the transfer belt when the blade is not used, and then is fixed in a state in which an urging force between the transfer belt and the blade is lowered.

By employing this constitution, a large load is not exerted on the blade when the blade is not used, so that the blade is not plastically deformed even when the blade is stored for a long time in a state in which the blade is not used.

Further, as described above, the blade moved toward the side away from the transfer belt when the blade is not used has a constitution in which the blade is returned to a normal contact position during normal use and then is pressed against the transfer belt again to obtain power for removing the residual toner on the transfer belt.

When the constitution is employed, in a conventional constitution, in order to move the blade away from the transfer belt, an exclusive component structure or control is added in many cases, so that such a constitution led to upsizing of the device and an increase in the number of constituent parts.

SUMMARY OF THE INVENTION

A principal object of the present invention is to provide an image forming apparatus capable of easily moving a blade for removing a toner on a transfer belt while suppressing upsizing of a device and an increase in the number of constituent parts.

According to an aspect of the present invention, there is provided an image forming apparatus comprising: a transfer unit including a stretching roller and a rotatable transfer belt stretched by the stretching roller; a cleaning unit, including a blade movable toward and away from the transfer belt, for collecting a toner removed from the transfer belt by the blade; a moving member for moving the blade between a contact position where the blade is contacted to the transfer belt and a retracted position where the blade is moved away from the transfer belt; and a drive transmission device for permitting transmission of a driving force between the stretching roller and the movable member, wherein the drive transmission device has an idling region where the drive transmission device is rotatable by a predetermined amount without transmitting the driving force to the stretching roller when the driving force is transmitted from the moving member to the drive transmission device.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be specifically described with reference to the drawings. Dimensions, materials, shapes and relative arrangements of constituent elements described in the following embodiments should be appropriately be changed depending on structures and various conditions of devices (apparatuses) to which the present invention is applied. Accordingly, the scope of the present invention is not intended to be limited to the following embodiments unless otherwise specified.

[Embodiment 1]

Figure 1:
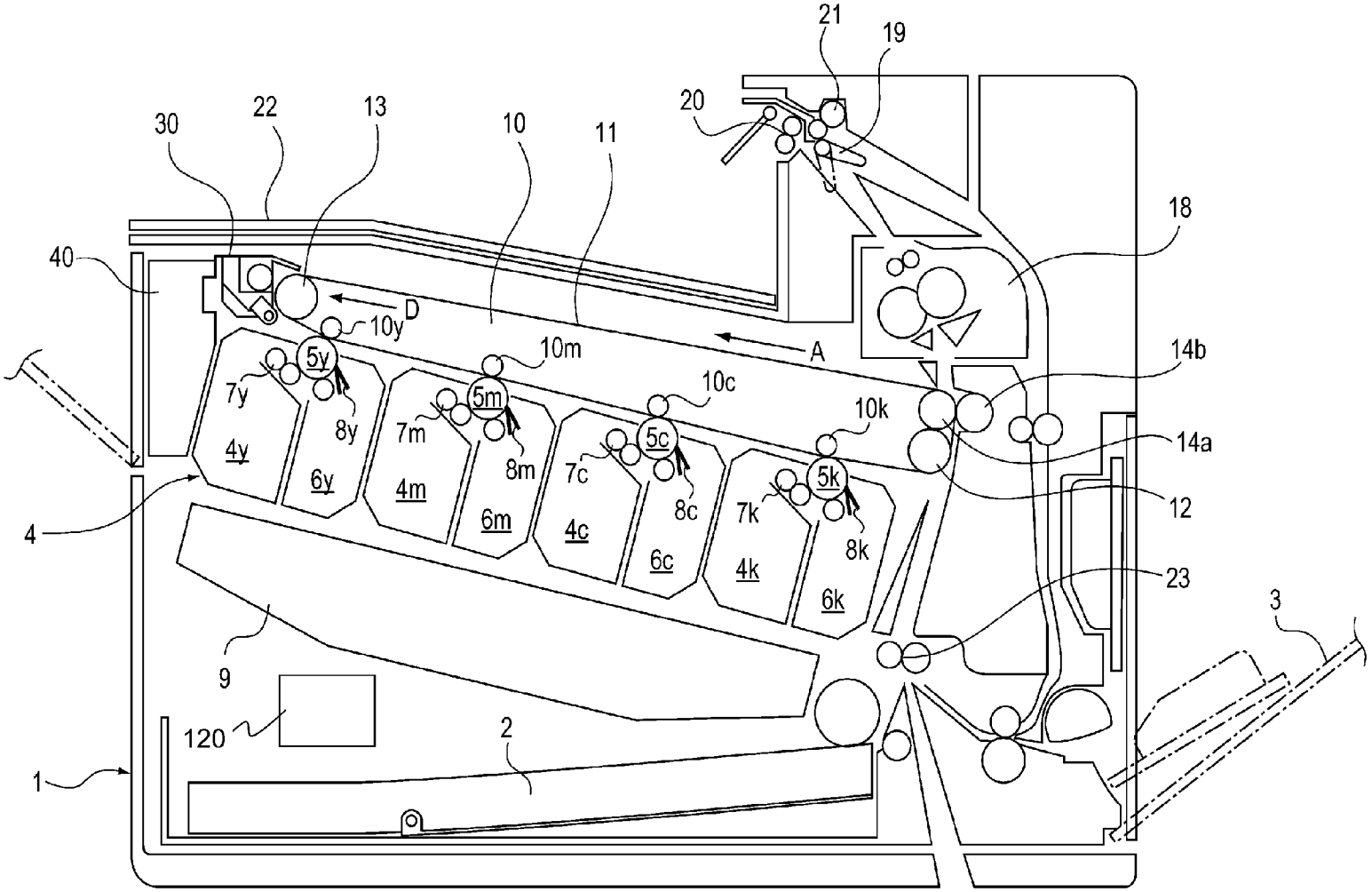
FIG. 1 is a sectional view of a main assembly of an image forming apparatus of Embodiment 1.

Embodiment 1 of the present invention will be described using a four-drum color image forming apparatus of an electrophotographic type. In this embodiment, a full-color laser beam printer as the color image forming apparatus is illustrated as an example. FIG. 1 is a sectional view showing a general structure of a full-color laser beam printer 1.

As shown in FIG. 1, at a lower portion of the printer 1, a cassette 2 is accommodated so as to be pullable out. At a side portion of the printer 1, a manual feeding portion 3 is provided. Sheets of a transfer material are stacked and accommodated in each of the cassette 2 and the manual feeding portion 3 and then are constituted so as to be separated and fed one by one.

The printer 1 includes process cartridges 4*y*, 4*m*, 4*c* and 4*k* (process cartridges 4) which are juxtaposed in line as image forming portions and which corresponds to yellow, magenta, cyan and black, respectively. In the process cartridges 4, photosensitive drums 5*y*, 5*m*, 5*c* and 5*k* as an image bearing member, and charging members 6*y*, 6*m*, 6*c* and 6*k* for negatively charging surfaces of the photosensitive drums 5 uniformly are provided. Further, in the process cartridges 4, developing rollers 7*y*, 7*m*, 7*c* and 7*k* for developing electrostatic latent images into toner images by depositing toners on the electrostatic latent images, and cleaning blades 8*y*, 8*m*, 8*c* and 8*k* (first cleaning blades 8) for removing residual toners remaining on the photosensitive drums 5 are provided. The developing rollers 7 are constituted so as to be moved toward and away from the photosensitive drums 5. In synchronism with the images developed from the electrostatic latent images, by moving the developing rollers 7 toward and away from the photosensitive drums 5, lifetimes of the developing rollers 7 are improved.

Further, a scanner unit 9 (exposure means) for forming the electrostatic latent images on the photosensitive drums 5 by irradiating the photosensitive drums 5 with laser beams on the basis of image information is provided below the process cartridges 4. Further, an intermediary transfer unit 10 is provided above the process cartridges 4.

The intermediary transfer unit 10 includes primary transfer rollers 10*y*, 10*m*, 10*c* and 10*k*, an intermediary transfer belt 11, a driving roller 12, a tension roller 13 and a secondary transfer opposite roller 14*a* are provided. The intermediary transfer belt 11 is an endless belt (transfer belt) and is stretched by the driving roller 12, the tension roller 13 and the secondary transfer opposite roller 14*a* which are stretching rollers. The tension roller 13 is urged by an urging means (not shown) in an arrow D direction shown in FIG. 1, so that predetermined tension is applied to the intermediary transfer belt 11. Then, the driving roller 12 is rotationally driven by a motor (not shown) or the like controlled by a rotation control device 120, so that the intermediary transfer belt 11 is rotated at a predetermined speed in an arrow A direction in FIG. 1.

Further, the intermediary transfer unit 10 in this embodiment includes a cleaning unit 30 for removing the toner remaining on the intermediary transfer belt 11. The cleaning unit 30 is provided upstream of a primary transfer portion formed by the photosensitive drum 5*y* and the primary transfer roller 10*y* with respect to a rotational direction (arrow A direction in FIG. 1) and downstream of a secondary transfer portion formed by the secondary transfer opposite roller 14 and a secondary transfer roller 14*b* with respect to the rotational direction. The cleaning unit 30 is disposed to fall within a height of the intermediary transfer unit 10 by being provided oppositely to the tension roller 13.

Further, a toner collecting container 40 is provided in the neighborhood of the cleaning unit 30, and a part thereof is connected with the cleaning unit 30. When a full state of the toner is detected by an unshown full-state detecting means, a message to that effect is displayed on an operating panel and then a user performs an exchanging operation of the toner collecting container 40. Further, the toner collecting container 40 is detachably mountable to a main assembly of the image forming apparatus alone.

The toner images developed from the electrostatic latent images on the photosensitive drums 5 by the developing rollers 7 are primary-transferred onto the intermediary transfer belt 11. The primary transfer is effected at the primary transfer portions formed by the primary transfer rollers 10*y*, 10*m*, 10*c* and 10*k* and the photosensitive drums 5*y*, 5*m*, 5*c* and 5*k*. At the primary transfer portions, a positive bias voltage is applied to the primary transfer rollers 10*y*, 10*m*, 10*c* and 10*k*, so that a potential difference between each of the primary transfer rollers 10*y*, 10*m*, 10*c* and 10*k* and a surface of an associated one of the photosensitive drums 5 is used to effect the primary transfer of the toner image onto the intermediary transfer belt 11.

The toner images primary-transferred on the intermediary transfer belt 11 are transferred onto the transfer material at the secondary transfer portion formed by the secondary transfer opposite roller 14*a* and the secondary transfer roller 14*b*. Thereafter, the transfer material passes through a fixing device 18 for effecting fixing. Thereafter, a feeding path of the transfer material is switched by a flapper 19 for double-side printing and then the transfer material is fed to either one of a discharging roller pair 20 or a switch-back roller pair 21. The transfer material fed toward the switch-back roller pair 21 is turned upside down and fed by the switch-back roller pair 21, and passes again through the secondary transfer portion 14 and the fixing device 18, and thereafter is fed toward the discharging roller pair 20. The transfer material is, after passes through the discharging roller pair 20, discharged onto a transfer material stacking portion 22.

Further, a sheet feeding means 23 is provided obliquely below a side wall close to the secondary transfer portion of the intermediary transfer belt 11 and close to the process cartridge 4*k*. This arrangement contributes to downsizing of the image forming apparatus.

Figure 2:
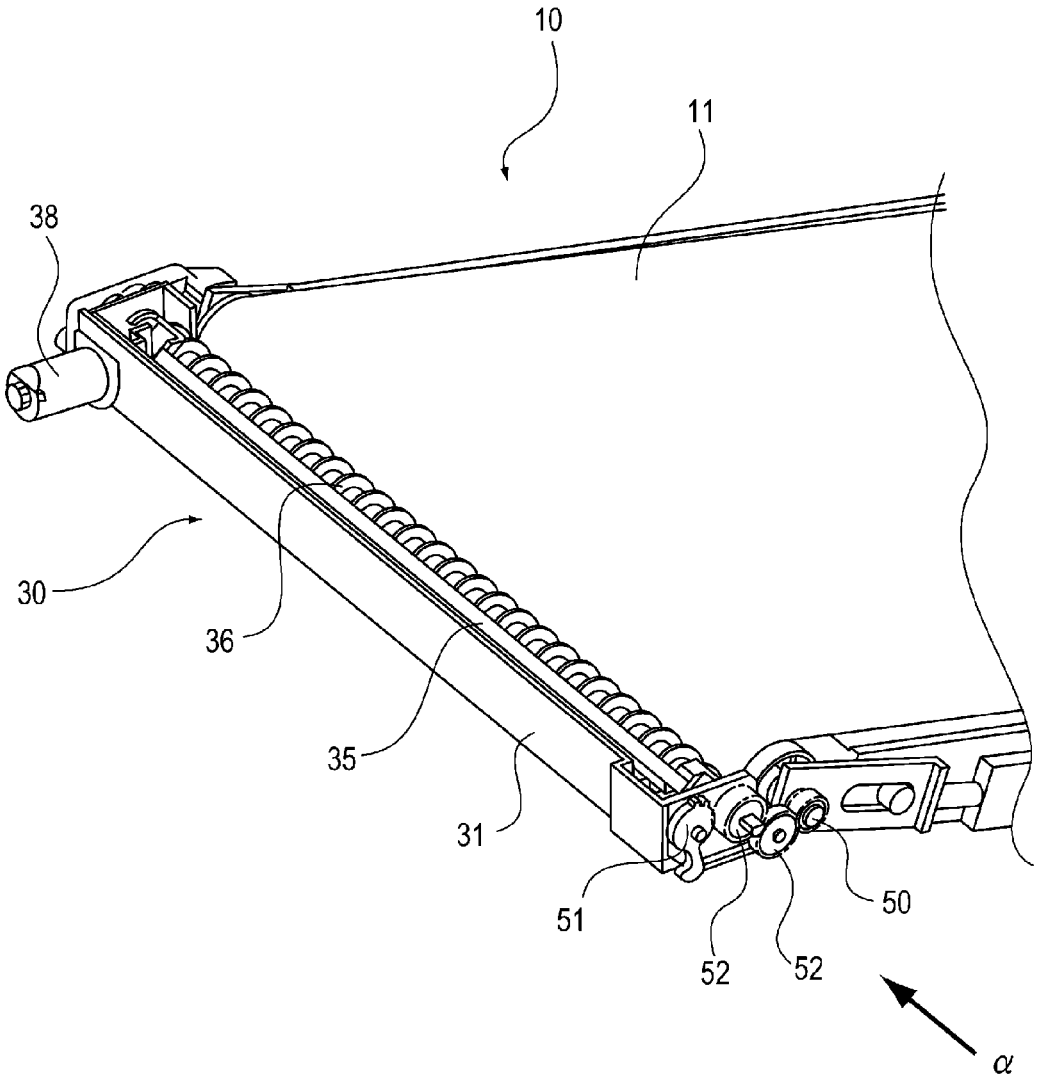
FIG. 2 is a perspective view of a structure of a cleaning unit in Embodiment 1.
Figure 3:
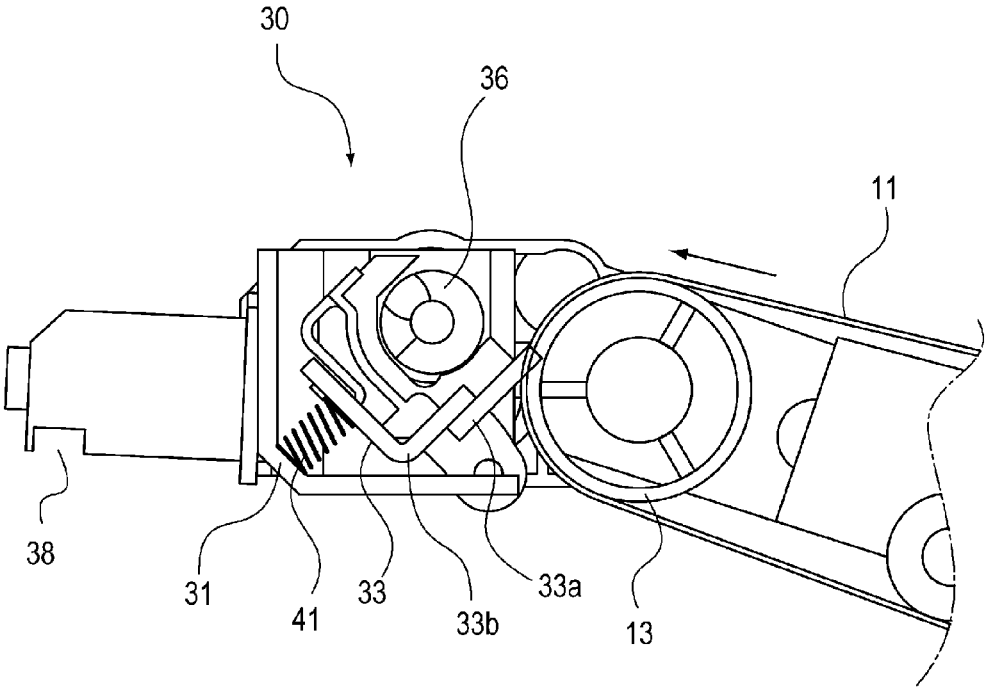
FIG. 3 is a sectional view of the structure of the cleaning unit in Embodiment 1.

The cleaning unit 30 will be specifically described with reference to FIGS. 2 and 3. FIG. 2 is a perspective view of the cleaning unit 30 and the intermediary transfer belt 11 when they are views from obliquely above in a front side. FIG. 3 is a sectional view for illustrating the cleaning unit 30 as seen in an arrow a direction in FIG. 2.

As shown in FIGS. 2 and 3, an inside of the cleaning unit 30 is constituted by a cleaning container 31, a top cover (not shown), a cleaning blade 33 (33*a*, 33*b*), a toner feeding wall 35, a toner feeding screw 36 and a toner portion 38.

The cleaning unit 30 is provided so that at the cleaning blade 33 contacts the intermediary transfer belt 11 over a direction (longitudinal direction) perpendicular to the rotational direction of the intermediary transfer belt 11.

The cleaning blade 33 uses a deformable elastic rubber as a material for a cleaning portion 33*a* thereof, and the blade portion 33*a* is bonded to a blade holding metal plate 33*b*. Further, the cleaning blade 33 has a width, with respect to a longitudinal direction of not less than a width of a maximum-sized transfer material on which the image can be formed by the image forming apparatus, and removes the toner on the intermediary transfer belt 11 by being press-contacted to the intermediary transfer belt 11. Further, in order to obtain a desired linear pressure at which the toner is removable, the cleaning blade 33 is pressed (urged) toward various rollers provided inside the intermediary transfer belt 11 in general. In this embodiment, the cleaning blade 33 is pressed toward the tension roller 13 via the intermediary transfer belt 11 by press-contact springs 41 (pressing (urging) member) at two longitudinal end portions. On the blade holding metal plate 33*b*, the plastic toner feeding wall 35 (contact portion) is mounted. Further, the toner feeding screw 36 as a toner feeding member is provided in a toner feeding path formed (defined) by the cleaning blade 33, the toner feeding wall 35 and the top cover (not shown). The toner feeding screw 36 is rotatably held at end portions thereof by the cleaning container 31. Further, a driving force is transmitted to the toner feeding screw 36 by a screw driving gear (not shown) provided at an end portion of the toner feeding screw 36, so that the toner feeding screw 36 is rotated clockwise in FIG. 3.

The toner scraped off from the intermediary transfer belt 11 by the cleaning blade 33 is deposited on the blade portion 33*a* of the cleaning blade 33, and then is started to be gradually deposited above the blade holding metal plate 33*b*. Then, the toner contacting the toner feeding screw 36 is fed to a longitudinal end portion (toward the toner discharge opening 38) by a screw tooth surface of the toner feeding screw 36.

The toner fed toward the toner discharge opening 38 is, after passing through the toner discharge opening 38, collected in the toner collecting container 40 shown in FIG. 1.

The cleaning blade 33 is pressed against the intermediary transfer belt 11 by the press-contact spring 41. In the contact state, the cleaning blade 33 is always in a pressed state, and therefore there is a liability that the cleaning blade 33 is deformed. For that reason, the cleaning blade 33 is constituted so as to be movable toward and away from the intermediary transfer belt 11. Next, a moving operation for moving the intermediary transfer belt 11 away from the intermediary transfer belt 11 will be described with reference to FIGS. 4-6.

In this embodiment, movement of the cleaning blade 33 away from the intermediary transfer belt 11 is made as described above when the image forming apparatus including the cleaning unit 30 is stored for a long term. For that reason, this operation is principally performed by an operator during manufacturing or a service person, or by a user in some cases.

At one of longitudinal end portions of the tension roller 13, a drive transmission gear 50 as a drive transmission member is provided. The drive transmission gear 50 includes a bearing portion 501 (portion-to-be-engaged) connected with a driving portion CD of the tension roller 13, and the bearing portion 501 has an idling region t where the tension roller 13 can be rotated, from a position where the tension roller 13 is in a driven state, further in a normal direction (arrow A direction) by a predetermined amount. The driving portion DC is a D-cut-shaped projected portion, and the bearing portion 501 has such a shape that the D-cut-shaped projected portion is engageable with the bearing portion 501. By this idling region t, when the tension roller 13 is rotated by rotation (movement) of the intermediary transfer belt 11, the drive transmission gear 50 is not rotated, and can be in a rest state.

Figure 4:
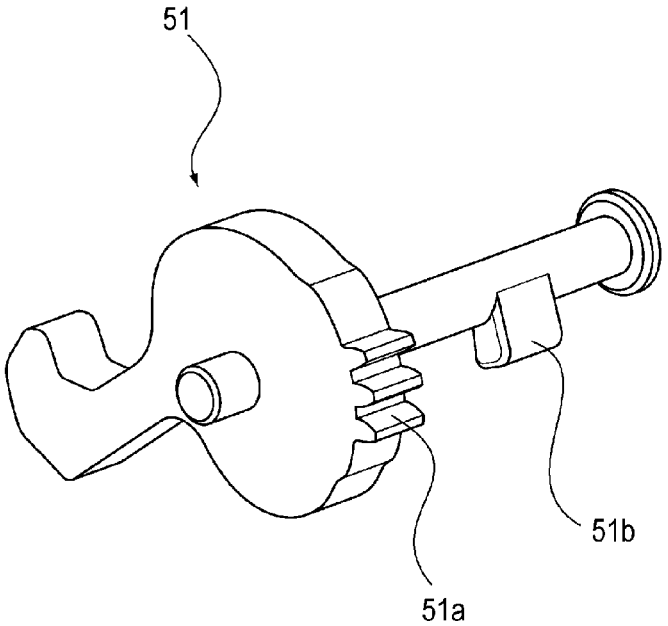
FIG. 4 is an illustration of a blade moving member in Embodiments 1 and 2.
Figure 5:
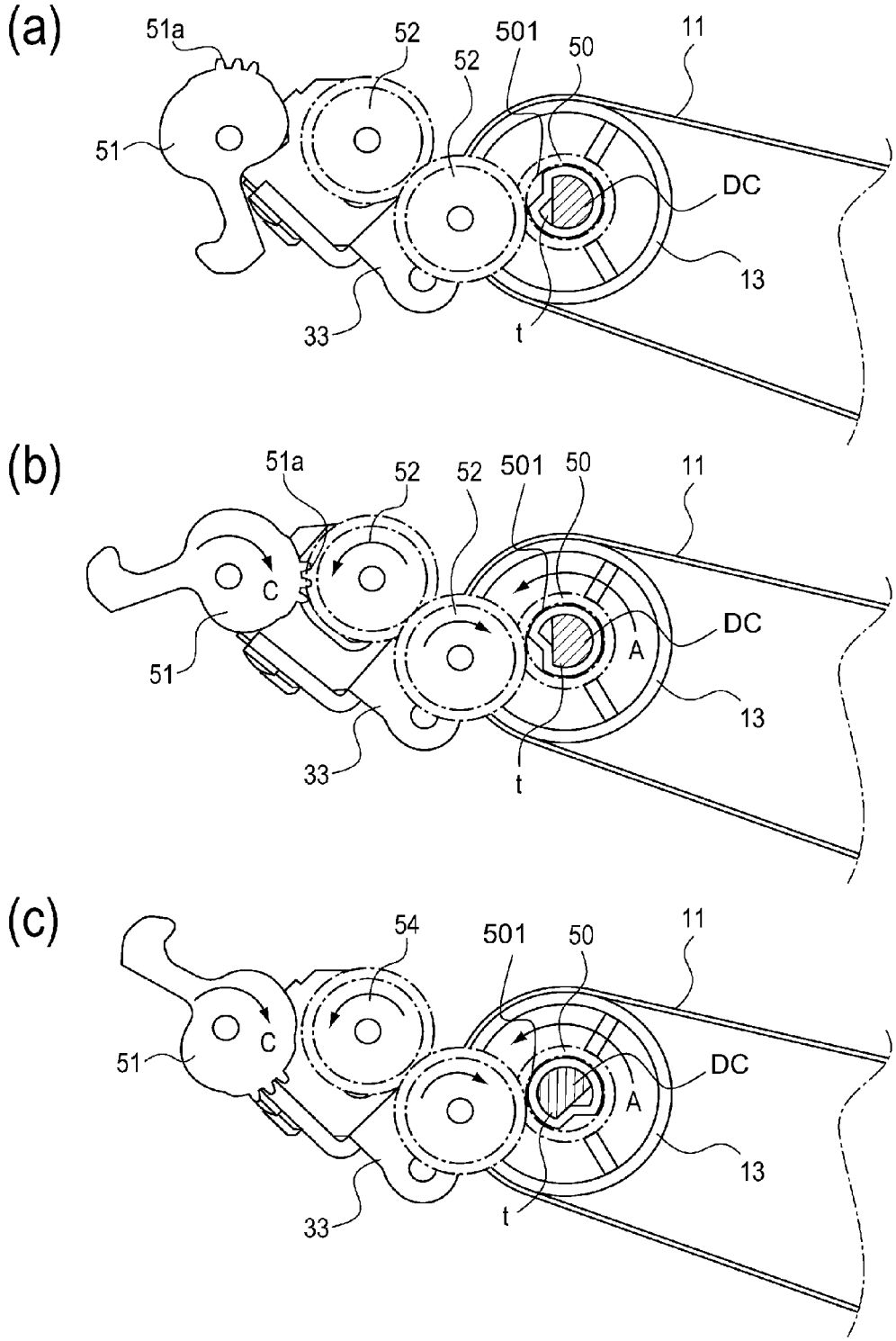
In FIG. 5, (a) to (c) are operation illustrations of a drive transmission gear and the blade moving member in Embodiments 1 and 2.

As a means for moving the cleaning blade 33 away from the intermediary transfer belt 11, a lever 51 as a moving member is provided, so that a rotational driving force can be transmitted from the drive transmission gear 50. Specifically, between the lever 51 and the drive transmission gear 50, two idler gears 52 are provided, so that the rotational driving force from the drive transmission gear 50 is transmitted to the lever 51. The lever 51 includes a gear-shaped portion 51*a* having partly omitted teeth as a part thereof as shown in FIG. 4, and in the case where when the lever 51 is rotated in an arrow C direction, the lever 51 can obtain a rotational driving force from the drive transmission gear 50 via the two idler gears 52. Further, the lever 51 includes a cam-shaped portion 51*b* (cam portion) as a part thereof, and the cam-shaped portion 51*b* is disposed so as to be actable on the toner feeding wall 35 (contact portion) provided on the cleaning blade 33. As shown in FIG. 5, the lever 51 is disposed at a position of (a) of FIG. 5 in an initial state thereof, and the gear-shaped portion 51*a* having partly omitted teeth is not in a state in which the rotation driving force is transmitted to the gear-shaped portion 51*a*. When the lever 51 is in the position of (a) of FIG. 5, the cam-shaped portion 51*b* of the lever 51 is, as shown in (a) of FIG. 6, in a position away from the toner feeding wall 35.

In the case where before the apparatus main assembly is stored for a long term, the operator or the like moves the cleaning blade 33 from the state (position) of (a) of FIG. 5 toward a side away from the intermediary transfer belt 11, the operator rotates the lever 51 in the arrow C direction in (b) of FIG. 5. The drive transmission gear 50 including the bearing portion 501 connected with the tension roller 13 has, at the bearing portion 501, the idling region t where the tension roller 13 can further rotate in the normal direction (arrow A direction) by the predetermined amount. The idling region t is equal to or larger than an amount of rotation of the lever 51 in the arrow C direction. As a result, when the lever 51 is rotated in the arrow C direction, only the drive transmission gear 50 rotates in the normal direction (arrow A direction) while the intermediary transfer belt 11 and the tension roller 13 do not rotate, and moves to a position of (b) of FIG. 5. In the case where the lever 51 is in the position of (b) of FIG. 5, the cam-shaped portion 51*b* of the lever 51 and a top portion of the cam contact a flat surface portion of the toner feeding wall 35 and urge the cleaning blade 33 in a direction in which the cleaning blade 33 is moved away from the intermediary transfer belt 11 as shown in (b) of FIG. 6. By this operation, the toner feeding wall 35 and the cleaning blade 33 are rotated in an arrow B direction as shown in (b) of FIG. 6, so that the cleaning blade 33 is moved from a contact position where the cleaning blade 33 contacts the intermediary transfer belt 11 to a retracted position where the cleaning blade 33 is retracted toward the side away from the intermediary transfer belt 11.

In the case where the intermediary transfer unit 10 is rotationally driven from the state of (b) of FIG. 5, the intermediary transfer belt 11 and the tension roller 13 are rotated in the arrow A direction (normal direction) of (c) of FIG. 5, and also the drive transmission gear 50 connected therewith is rotated in the arrow C direction in (c) of FIG. 5. When the drive transmission gear 50 is rotated in the arrow A direction as shown in (c) of FIG. 5, the lever 51 is rotated in the arrow C direction, so that the cam-shaped portion 51*b* thereof is moved to a position of (c) of FIG. 6 where the action of the cam-shaped portion 51*b* on the cleaning blade 33 is eliminated. When the lever 51 is in a position of (c) of FIG. 6, the cam-shaped portion 51*b* of the lever 51 is moved away from the toner feeding wall 35. As a result, the toner feeding wall 35 and the cleaning blade 33 are urged by the press-contact spring 41 toward a side where they approach the intermediary transfer belt 11 (in the arrow D direction in (c) of FIG. 6), so that the toner feeding wall 35 and the cleaning blade 33 are returned from the retracted position, where the cleaning blade 33 is retracted toward the side away from the intermediary transfer belt 11, to the contact position where the cleaning blade contacts the intermediary transfer belt 11.

Therefore, by employing the above-described constitution, during the blade movement operation, only by such a simple operation that the lever 51 is rotationally moved, the cleaning blade 33 can be moved toward the side away from the intermediary transfer belt 11. That is, by the above-described constitution, it is possible to not only suppress the upsizing of the device and the increase in the number of constituent parts but also simply move the cleaning blade 33 in the direction in which the cleaning blade 33 is moved away from the intermediary transfer belt 11 without performing a special procedure such as use of a tool or the like also during the blade movement operation. As a result, even in the case where the cleaning blade is stored for a long term when the cleaning blade is not used, the cleaning blade is prevented from being plastically deformed, so that residual toner removing power of the cleaning blade is not impaired when the cleaning blade is used.

In this embodiment, for convenience of downsizing of the parts, description was made using a single blade movement operation, but the present invention is not limited thereto. For example, it is possible to perform a plurality of blade movement operations by, e.g., changing the shape of the lever portion so that the lever 51 is rotatable further by increasing the number of teeth of the gear-shaped portion 51*a* having partly omitted teeth of the lever.

Further, in this embodiment, a constitution in which the two gears (idling regions 52) are interposed between the drive transmission gear 50 and the lever 51 is illustrated as an example, but the present invention is not limited thereto. Even in the case where a gear train consisting of even-numbered gears is interposed between the drive transmission gear 50 and the lever 51 or in the case where there is no gear train, by a similar operation, the cleaning blade 33 can be moved away from the intermediary transfer belt 11. Further, in the case where a gear train consisting of odd-numbered gears is interposed between the drive transmission gear 50 and the lever 51, by reversing the operation direction of the lever 51 during the blade movement operation, the cleaning blade 33 can be moved in a similar motion.

Embodiment 2 of the present invention will be described using a four-drum color image forming apparatus of an electrophotographic type similarly as in Embodiment 1 described above. Also in this embodiment, a full-color laser beam printer as the color image forming apparatus is illustrated as an example. A full-color laser beam printer 1 in this embodiment is the same as that in Embodiment 1 except for peripheral parts of the drive transmission gear 50 and the lever 51 in the image forming apparatus, and therefore will be omitted from description. A characteristic portion different in peripheral parts of the drive transmission gear 50 and the lever 51 from Embodiment 1 will be described.

Figure 7:
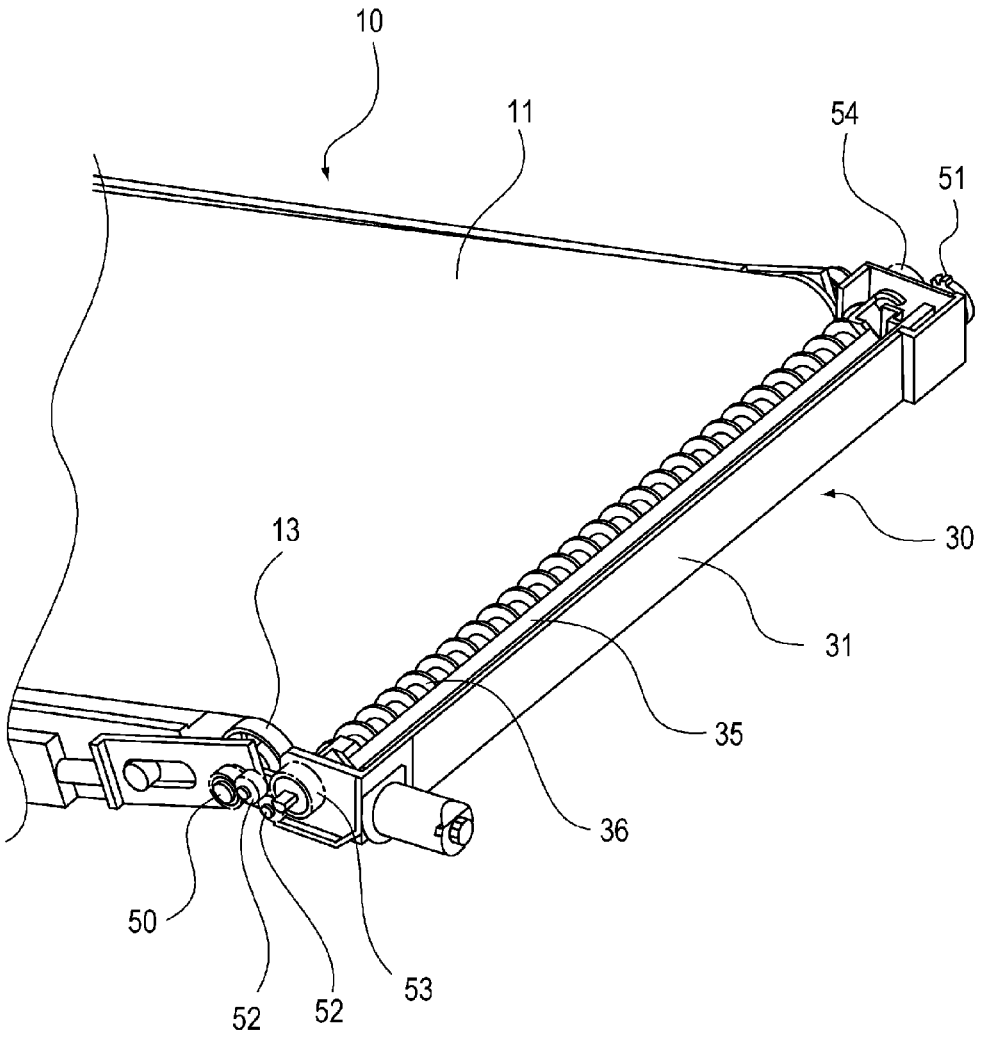
FIG. 7 is a perspective view of a structure of a cleaning unit in Embodiment 2.

A cleaning unit 30 in this embodiment will be described with reference to FIG. 7. FIG. 7 is a perspective view of a structure of the cleaning unit 30 in this embodiment.

As shown in FIG. 7, a drive transmission gear 50 as a drive transmission member is connected with the tension roller 13 as the stretching roller for stretching the intermediary transfer belt 11. The drive transmission gear 50 includes the bearing portion 501 connected with the tension roller 13, and the bearing portion 501 has an idling region t where the tension roller 13 can be rotated further from a position, where the tension roller 13 in a driven state, by a predetermined amount. In a downstream side, two idler gears 52 are connected with the drive transmission gear 50, and in a further downstream side, a screw driving gear 53 is constituted with the idler gears 52. With the screw driving gear 53, the toner feeding screw 36 for feeding the residual toner collected in the cleaning unit 30 is connected. Accordingly, the rotational driving force from the tension roller 13 is transmitted to the toner feeding screw 36 via the drive transmission gear 50 and the idler gears 52.

In the case where the intermediary transfer belt 11 and the tension roller 13 are normally driven, the toner feeding screw 36 obtains the rotational driving force via the drive transmission gear 50, the idler gears 52 and the screw driving gear 53 and thus rotates in a toner feeding direction. By this operation, the toner feeding screw 36 can feed, toward the toner discharge opening 38, the residual toner which is collected in the cleaning unit 30 by the cleaning blade 33 and which is deposited on the toner feeding wall 35.

In a downstream side of the toner feeding screw 36 (in an opposite side from the screw driving gear 53 with respect to the longitudinal direction), a screw opposite gear 54 is connected with the toner feeding screw 36. In a downstream side of the screw opposite gear 54, a lever 51 including a gear-shaped portion 51*a* having partly omitted teeth a part thereof is provided. The lever 51 is disposed so as to be connectable with the screw opposite gear 54 disposed upstream of the lever 51, and can obtain a rotational driving force of the screw opposite gear 54 in a state in which gear-shaped portions of the lever 51 and the gear 54 are connected with each other. Further, the lever 51 includes a cam-shaped portion 51*b* (FIGS. 4 and 6) as a part thereof, and the cam-shaped portion 51*b* is connected with the toner feeding wall 35 provided on the cleaning blade 33.

Figure 8:
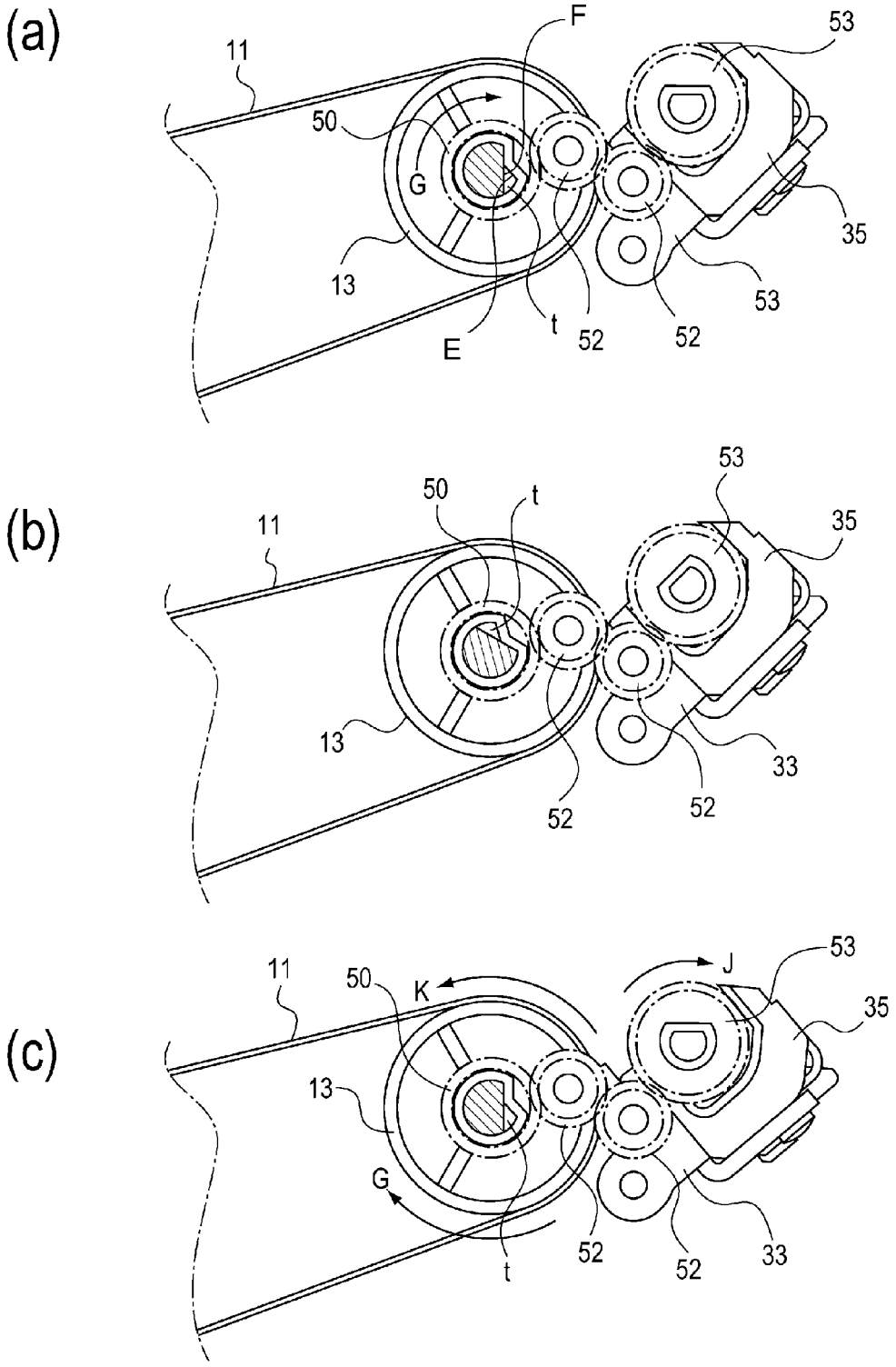
In FIG. 8, (a) to (c) are operation illustrations of the drive transmission gear and the blade moving member in Embodiment 2.

Next, a moving operation for moving the cleaning blade 33 in a direction in which the cleaning blade 33 is moved away from the intermediary transfer belt 11 will be described with reference to FIGS. 6, 8 and 9. In FIG. 8, (a) to (c) are operation illustrations of the drive transmission gear and the lever in this embodiment, and in FIG. 9, (a) to (c) are operation illustrations of the lever and the cleaning blade in this embodiment. As shown in FIG. 8, the drive transmission gear 50 is disposed at a position of (a) of FIG. 8 in an initial state thereof. At this time, the lever 51 is disposed at a position of (a) of FIG. 9, and the gear-shaped portion 51*a* having partly omitted teeth is not connected with the screw opposite gear 54. When the lever 51 is in the position of (a) of FIG. 8, the cam-shaped portion 51*b* of the lever 51 is, as shown in (a) of FIG. 6, in a position away from the toner feeding wall 35.

In the case where the cleaning blade 33 is moved from the state (position) of (a) of FIG. 8 toward a side away from the intermediary transfer belt 11, before the moving operation of the lever 51, the intermediary transfer belt 11 and the tension roller 13 are rotated by the rotation control device 120 in an opposite direction to the normal direction (arrow G direction in (a) of FIG. 8) by a predetermined amount. By this operation, a surface E of the drive transmission gear 50 and a surface F of the shaft of the tension roller 13 are in a contact state, so that the idling region t of the drive transmission gear 50 is moved to a position of (b) of FIG. 8.

In this embodiment, in order to place the surface E of the drive transmission gear 50 and the surface F of the tension roller 13 in the contact state, a method of reversely rotating the intermediary transfer belt 11 and the shaft of the tension roller 13 is used, but the present invention is not limited thereto. For example, only the drive transmission gear 50 is rotated in the arrow G direction in (a) of FIG. 8 by manually rotating, in an arbitrary direction, any of, e.g., the screw driving gear 53, the idler gears 52 and the screw opposite gear 54, so that the surface E of the drive transmission gear 50 and the surface F of the shaft of the tension roller 13 may also be placed in the contact state.

Figure 9:
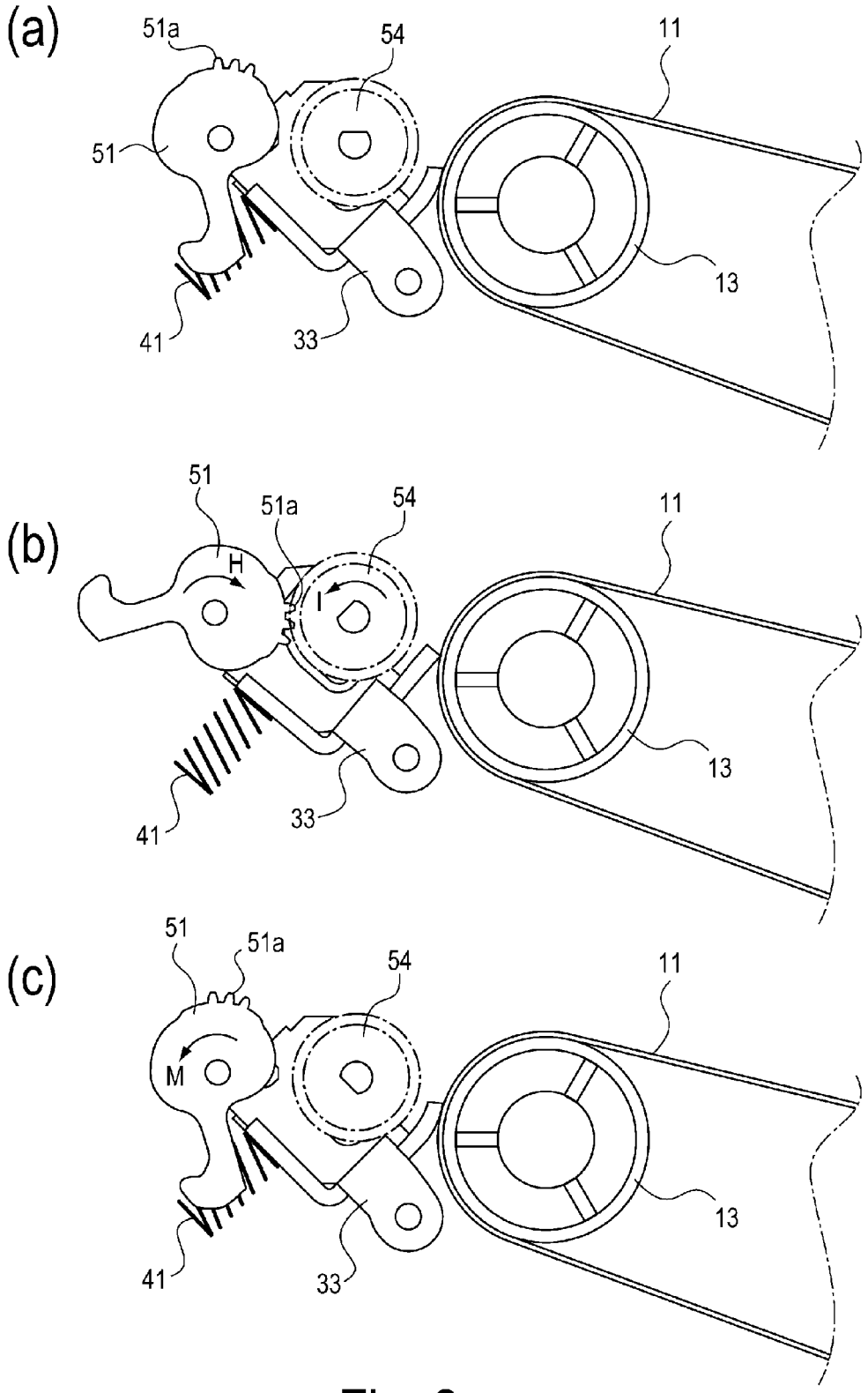
In FIG. 9, (a) to (c) are operation illustrations of the blade moving member and a cleaning blade in Embodiment 2.

Then, the operator or the like manually rotates the lever 51 in an arrow H direction of (b) of FIG. 9. When the lever 51 is rotated in the arrow H direction of (b) of FIG. 9, the screw opposite gear 54 connected with the gear-shaped portion 51*a* having partly omitted teeth of the lever 51 is rotated in an arrow I direction of (b) of FIG. 9. The screw opposite gear 54 is connected with the screw driving gear 53 via the toner feeding screw 36, and therefore the screw driving gear 53 is rotated in an arrow J direction of (c) of FIG. 8. The drive transmission gear 50 including the bearing portion 501 connected with the tension roller 13 has, at the bearing portion 501, the idling region t where the tension roller 13 can further rotate in a direction opposite to the arrow G direction by a predetermined amount. The idling region t is equal to or larger than an angle of rotation of the lever 51 in an arrow H direction of (b) of FIG. 9. Further, the idling region t is moved to a position of (b) of FIG. 8 by the above-described operation. As a result, when the lever 51 is rotated in the arrow H direction of (b) of FIG. 9, only the drive transmission gear 50 rotates in the arrow K direction of (c) of FIG. 8 while the intermediary transfer belt 11 and the tension roller 13 do not rotate, and moves to a position of (c) of FIG. 8. In the case where the lever 51 is in the position of (b) of FIG. 9, similarly as Embodiment 1, the cam-shaped portion 51*b* of the lever 51 is connected with the toner feeding wall 35 and urges the cleaning blade 33 in a direction in which the cleaning blade 33 is moved away from the intermediary transfer belt 11 as shown in (b) of FIG. 6. By this operation, the toner feeding wall 35 and the cleaning blade 33 are moved from a contact position where the cleaning blade 33 contacts the intermediary transfer belt 11 to a retracted position where the cleaning blade 33 is retracted toward the side away from the intermediary transfer belt 11.

Figure 6:
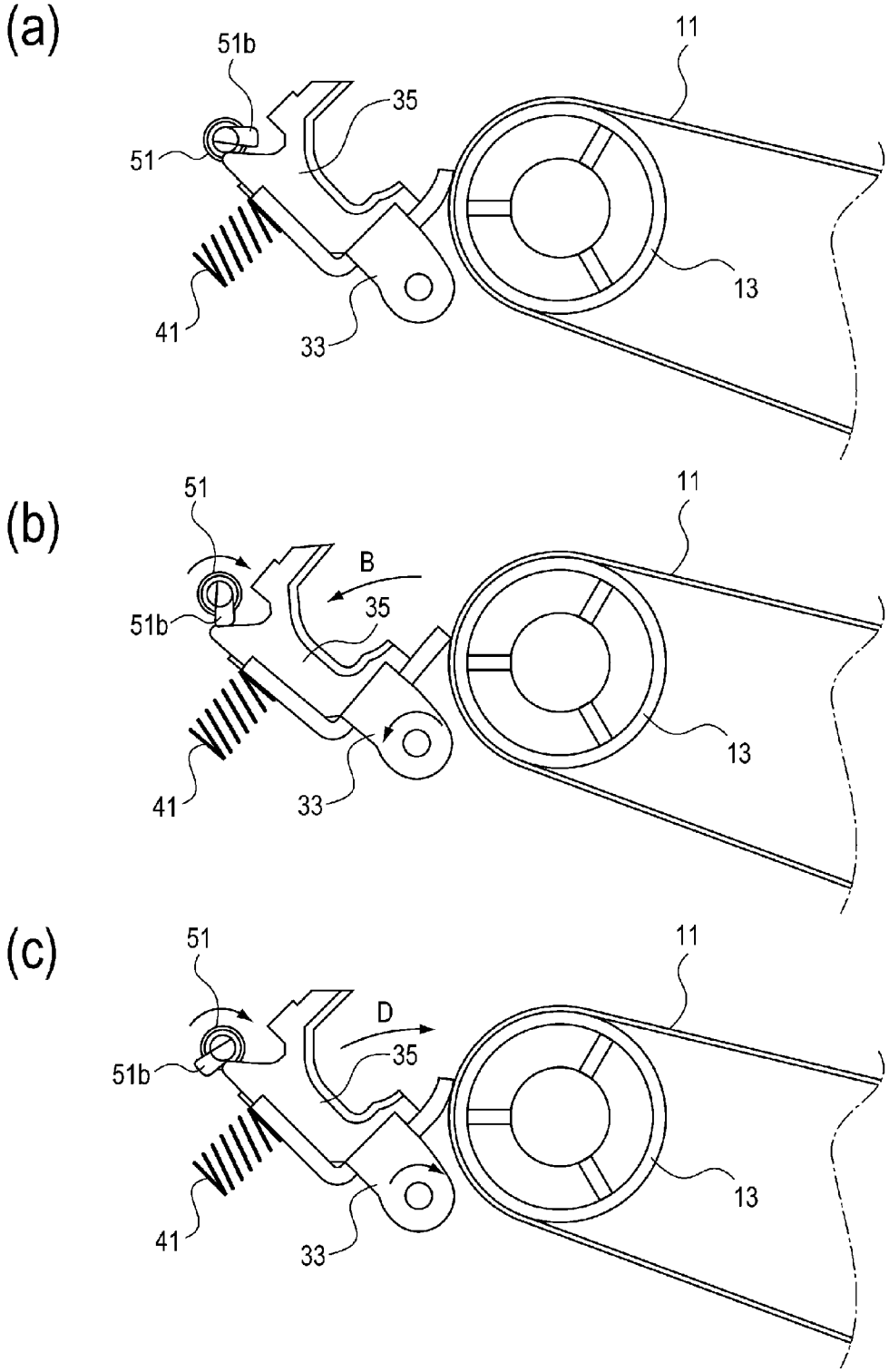
In FIG. 6, (a) to (c) are operation illustrations of the blade moving member and a cleaning blade in Embodiment 1.

In the case where the intermediary transfer unit 10 performs a normal operation in (c) of FIG. 8, (b) of FIG. 6 and the state of (c) of FIG. 8, (b) of FIG. 6 and (b) of FIG. 9, the intermediary transfer belt 11 and the tension roller 13 are rotated in the arrow G direction of (c) of FIG. 8, and also the drive transmission gear 50 connected therewith is rotated in the arrow G direction. When the drive transmission gear 50 is rotated in the arrow G direction, the lever 51 is rotated in the arrow M direction of (c) of FIG. 9 via the idler gears 52, the screw driving gear 53, the toner feeding screw 36 and the screw opposite gear 54, so that lever 51 is moved to a position of (c) of FIG. 9. When the lever 51 is in a position of (c) of FIG. 9, the cam-shaped portion 51*b* of the lever 51 is moved away from the toner feeding wall 35 as shown in (a) of FIG. 6. That is, the cam-shaped portion 51*b* is moved to a position where the action thereof on the cleaning blade 33 is eliminated. As a result, the toner feeding wall 35 and the cleaning blade 33 are urged by the press-contact spring 41 toward a side where they approach the intermediary transfer belt 11, so that the toner feeding wall 35 and the cleaning blade 33 are returned from the retracted position, where the cleaning blade 33 is retracted toward the side away from the intermediary transfer belt 11, to the contact position where the cleaning blade contacts the intermediary transfer belt 11.

Therefore, by employing the above-described constitution, during the blade movement operation, only by such a simple operation that the lever 51 is rotationally moved, the cleaning blade 33 can be moved toward the side away from the intermediary transfer belt 11. Further, in this embodiment, before the moving operation of the cleaning blade 33 is performed, the reverse rotation control and the movement of the position of the idling region t of the drive transmission gear 50 by an arbitrary rotating means as shown in (b) of FIG. 8 are made. As a result, a movable range of the lever 51 becomes small, and the moving operation of the blade can be repetitively performed.

Further, by using the toner feeding screw 36 as the drive transmission means, even in the case where the drive transmission gear 50 and the lever 51 are spaced from each other, the cleaning blade 33 can be smoothly moved toward the side away from the intermediary transfer belt 11 without increasing the number of exclusive parts and upsizing the device.

In this embodiment, a constitution in which the two gears (idling regions 52) are interposed between the drive transmission gear 50 and the lever 51 is illustrated as an example, but the present invention is not limited thereto. Even in the case where even-numbered gears is interposed between the drive transmission gear 50 and the gear train of the lever 51 or in the case where there is no gear train, by a similar operation, the cleaning blade 33 can be moved away from the intermediary transfer belt 11. Further, in the case where odd-numbered gears is interposed between the drive transmission gear 50 and the gear train of the lever 51, by reversing the rotational direction of the lever 51 during the blade movement operation, the cleaning blade 33 can be moved in a similar motion.

[Other Embodiments]

In the above-described embodiments, as the image forming portions juxtaposed in line, the four process cartridges corresponding to yellow, magenta, cyan and black are provided, but the number of use of the image forming portions is not limited and may appropriately be set.

In the above-described embodiments, the intermediary transfer belt was described as the transfer, but a transfer material feeding belt for feeding the transfer material onto which the toner image is transferred from the photosensitive drum may also be used as the transfer belt.

In the above-described embodiments, as the process cartridge detachably mountable to the image forming apparatus, a process cartridge integrally including the process cartridge and, as the process means actable on the photosensitive drum, the charging means, the developing means and the cleaning means was illustrated as an example. However, the process cartridge is not limited thereto, but may also have a constitution in which in addition to the photosensitive drum, either one of the charging means, the developing means and the cleaning means may be integrally included.

In the above-described embodiments, the constitution in which the process cartridge including the photosensitive drum is detachably mountable to the image forming apparatus was described as an example, but the present invention is not limited thereto. For example, the image forming apparatus may also be an image forming apparatus in which each of constituent members are independently incorporated or an image forming apparatus to which each of the constitution members is detachably mountable.

In the above-described embodiments, the printer was described as an example of the image forming apparatus, but the present invention is not limited thereto. For example, the image forming apparatus may also be other image forming apparatuses such as a copying machine, a facsimile machine, and a multi-function machine having functions of these machines in combination. By applying the present invention to these image forming apparatuses, a similar effect can be obtained.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-068263 filed on Mar. 28, 2014, which is hereby incorporated by reference herein in its entirety.

What is claimed is:

1. An image forming apparatus comprising:

a transfer unit including a stretching roller and a rotatable transfer belt stretched by the stretching roller;

a cleaning unit, including a blade movable toward and away from the transfer belt, for collecting a toner removed from the transfer belt by the blade;

a moving member for moving the blade between a contact position where the blade is contacted to the transfer belt and a retracted position where the blade is moved away from the transfer belt; and a drive transmission device for permitting transmission of a driving force between the stretching roller and the moving member, wherein the drive transmission device has an idling region where the drive transmission device is rotatable by a predetermined amount without transmitting the driving force to the stretching roller when the driving force is transmitted from the moving member to the drive transmission device.

2. An image forming apparatus according to claim 1, wherein the drive transmission device includes a portion-to-be-engaged engageable with a driving portion provided at an axial end portion of the stretching roller.

3. An image forming apparatus according to claim 2, wherein the drive transmission device has the idling region at the portion-to-be-engaged, and the idling region is equal to or larger than an amount of the blade when the moving member moves the blade from the contact position to the retracted position.

4. An image forming apparatus according to claim 3, wherein the idling region is provided on a rotation locus of the driving portion.

5. An image forming apparatus according to claim 3, wherein when the transfer belt is rotated, a driving force is transmitted to the moving member so that the moving member moves the blade from the retracted position to the contact position.

6. An image forming apparatus according to claim 3, wherein the cleaning unit includes a pressing member for pressing the blade against the transfer belt and a contact portion contacting a cam portion provided on the moving member, and wherein when the blade is in the retracted position, by contact between the cam portion and the contact portion, a degree of pressing of the blade by said pressing member is reduced.

7. An image forming apparatus according to claim 1, wherein when a rotational direction of the transfer belt during image formation is a normal direction, the transfer belt is also rotatable in a reverse direction.

8. An image forming apparatus according to claim 7, wherein before a moving operation of the moving member, the transfer belt rotates in an amount equal to or larger than an amount of rotation thereof when the moving member moves the blade from the contact position to the retracted position.

9. An image forming apparatus according to claim 8, further comprising a rotation contact device for controlling rotational movement of the transfer belt.

10. An image forming apparatus according to claim 8, wherein the cleaning unit includes a feeding screw for feeding the toner, collected by said blade, to an end portion with respect to a longitudinal direction perpendicular to the rotational direction of the transfer belt, and wherein the feeding screw is rotated by transmitting the driving force from the drive transmission device.

11. An image forming apparatus according to claim 6, wherein the moving member includes a gear-shaped portion, as a part thereof, engageable with the drive transmission device.

12. An image forming apparatus according to claim 11, wherein in a state in which gear-shaped portion of the moving member engages with the drive transmission device, the cam portion of the moving member contacts the contact portion.

13. An image forming apparatus according to claim 12, wherein when the moving member rotates to eliminate the state in which the gear-shaped portion engages with the drive transmission device, a contact state of the cam portion of said moving member with the contact portion is eliminated.

14. An image forming apparatus according to claim 1, wherein the transfer belt is an intermediary transfer belt onto which a toner image is transferred from a photosensitive member.

* * * * *